United States Patent [19]

Iwano et al.

[11] Patent Number: 4,978,433

[45] Date of Patent: Dec. 18, 1990

[54] METHOD FOR RECOVERING SILVER FROM PHOTOGRAPHIC PROCESSING SOLUTION

[75] Inventors: Haruhiko Iwano; Fumio Nakagawa, both of Minami-ashigara, Japan

[73] Assignee: Fuji Photo Film Co., Ltd., Kanagawa, Japan

[21] Appl. No.: 332,902

[22] Filed: Apr. 4, 1989

[30] Foreign Application Priority Data

Apr. 5, 1988 [JP] Japan ..... 63-83505

[51] Int. Cl.[5] ..... C25B 1/00; C25B 15/00; C02F 1/46; C25C 1/22

[52] U.S. Cl. ..... 204/92; 204/149; 204/DIG. 13; 204/109

[58] Field of Search ..... 204/109, 149, DIG. 13, 204/228, 231, 291, 92

[56] References Cited

U.S. PATENT DOCUMENTS

| | | | |
|---|---|---|---|
| 1,937,179 | 11/1933 | Weisberg et al. | 204/109 |
| 3,524,805 | 8/1970 | Engelman | 204/228 |
| 4,013,527 | 3/1977 | Idota et al. | 204/149 |
| 4,021,319 | 5/1977 | Moeglich | 204/109 X |
| 4,073,705 | 2/1978 | Torikai et al. | 204/92 |
| 4,128,464 | 12/1978 | Idota | 204/109 X |
| 4,263,108 | 4/1981 | Berg et al. | 204/109 |
| 4,776,931 | 10/1988 | Hardy | 204/109 X |
| 4,800,005 | 1/1989 | Rosenfield et al. | 204/109 |
| 4,802,961 | 2/1989 | Woog et al. | 204/109 |

*Primary Examiner*—Donald R. Valentine

*Attorney, Agent, or Firm*—Sughrue, Mion, Zinn, Macpeak & Seas

[57] ABSTRACT

There is disclosed a method for recovering silver from photographic processing solution by electrolysis, in which method the cathode potential is set at a potential range wherein a precipitate of silver sulfide is formed in the electrolytic cell. According to the method, intensive silver recovering leading to low concentration of residual silver in the solution is achieved. Structure of electrolytic apparatus enabling easy separation of silver sulfide precipitates is also disclosed. Application of lead peroxide to the material of anode improves the life of the anode. Further advantages of the method are remarkable decreases in COD and iron contents of waste solution.

20 Claims, 1 Drawing Sheet

METHOD FOR RECOVERING SILVER FROM PHOTOGRAPHIC PROCESSING SOLUTION

FIELD OF THE INVENTION

The present invention relates to a method for recovering silver from a photographic processing (photoprocessing) solution containing silver salts or the waste solution thereof. More particularly, the present invention relates to an improved method for recovering silver by electrolysis.

BACKGROUND OF THE INVENTION

In a process of developing silver salt photographic materials, which may be color photographic materials or black-and-white photographic materials, a desilvering step follows a developing step, to remove silver and silver salts (hereinafter referred to simply as "silver") that have become unwanted in the photographic material, and it then passes into a processing solution.

Since the continuous processing of photographic material results in an accumulation of dissolved silver in the processing solution, ultimately the processing solution gradually loses its desilvering ability. Consequently, for economy, for the utilization of resources, or to comply with environmental protection regulations in some areas, it is required that silver is recovered from the silver-containing processing solution at a suitable stage, so that the processing solution can be made reusable (regeneration) or to make possible the processing of the waste solution. Further, BOD and COD of the waste solution is to be lowered to comply with environmental protection regulations.

Processing solutions capable of dissolving silver salts that are used in such a desilvering step are mainly fixing solutions (for color photographic materials and for black-and-white photographic materials) and bleach-fixing solutions (for color photographic materials). It is needless to say that since silver salts are carried by photographic materials in a washing bath or an image-stabilizing bath, which follows the desilvering step from the preceding bath, the washing bath and the image-stabilizing bath are also solutions from which silver is to be recovered. In this specification and claims, such processing solutions that contain silver and the waste solutions thereof are generally called "silver-containing solutions."

Various techniques for recovering silver from silver-containing solutions have long been known, and typical techniques are classified broadly into a metal-substitution process, a electrolytic recovery process, a chemical settling process, and an ion exchange resin process, which are further improved in various ways depending, for example, on the form of the developing process, properties of the photographic material, and regional circumstances.

The present invention relates, in particular among these, to an improvement in the electrolytic recovery process. As apparent from U.S. Pat. No. 1,876,830, the electrolytic recovery process is a method that has long been known and is in wide practical use. The advantages thereof are, for example, that chemical processing procedures are not required, that non-destructive recovery is possible, that is, changes of components other than silver can be kept small, thereby enabling a thus-treated solution to be advantageously used again as a processing solution, that since silver can be recovered in the form of a metal, recovered silver can be easily refined and highly purified, and that the electrolytic apparatus is simple and is small-sized. On the other hand, the electrolytic recovery process has such disadvantages that (1) the electrolysis speed is slow, (2) the recovering rate of silver is low, (3) if the silver-containing solutions came, in particular, from color processing, the recovering rate and the electric current efficiency are low due to the adulteration of iron salts. To correct the disadvantages, a method of electrolysis wherein silver is recovered not as metallic silver but as silver sulfide, that is, in which the applied voltage is kept high, is suggested and described in *Research Disclosure* (RD) No. 13702 (September 1975). In this regeneration method, sulfide ions ($S^{2-}$) are produced in an electrolytic chamber containing an aqueous solution of thiosulfate salts, and then they are transferred into a reaction chamber charged with a silver-containing waste solution to convert the silver to silver sulfide. The method is different from the present invention because the present invention contemplates to electrolize the silver-containing waste solution directly.

U.S. Pat. No. 1,937,179 discloses a method wherein silver is collected as silver sulfide (usually as silver) by electrolytic collection to allow a fixing solution to be reused. Thus, this method is different from the present invention with respect to the object, the procedure, and the conditions (such as applied electritic voltage) since electrolysis is conducted in the method substantially without causing any influence on the thiosulfate salts contained in the fixing solution to allow the fixing solution to be reused. Since this is a method for recovering part of dissolved silver and for reusing a fixing solution, the mode of this method is also different from that of the present invention.

However, although the method for recovering silver electrolytically as silver sulfide has improved electrolysis speed, it has the following disadvantages:

(1) The silver sulfide precipitate is in a state of suspended fine particles, which are difficult to separate.

(2) Since, in addition to the electrolytic cell, an independent reactor and settling tank are required, the apparatus becomes complicated and its cost is high.

(3) The current efficiency is low. This is regarded as being due to various secondary electrolytic reactions that take place simultaneously.

BRIEF SUMMARY OF THE INVENTION

Therefore, a first object of the present invention is to provide a method for recovering silver as silver sulfide from a photographic processing waste solution by an electrolytic process in order to make the electrolysis speed (per unit area of the electrode) high, to make the apparatus used therein compact (in terms of unit volume of waste solution to be treated), and to make the efficiency high.

A second object of the present invention is to provide a method for recovering silver electrolytically, wherein silver sulfide is produced as precipitated particles that are relatively large and easily separable.

A third object of the present invention is to provide a method for recovering silver by an electrolytically recovering apparatus that is simple in structure and low in cost.

A fourth object of the present invention is to provide an electrolytic method for removing silver effectively from a photographic processing waste solution with the current efficiency high.

A fifth object of the present invention is to provide a method wherein silver can be recovered economically with the current efficiency kept high, even for a silver-containing solution that comes from a color-developing solution that also contains iron salts.

A sixth object of the present invention is to provide a method and an apparatus for the electrolysis that are low in cost and convenient in procedure, so that the process and the apparatus may be employed, in particular, even in a small-scale photofinishing laboratory.

The above and other objects, features, and advantages of the invention will become apparent in the following description and drawings.

DETAILED DESCRIPTION OF THE INVENTION

Figure 1:
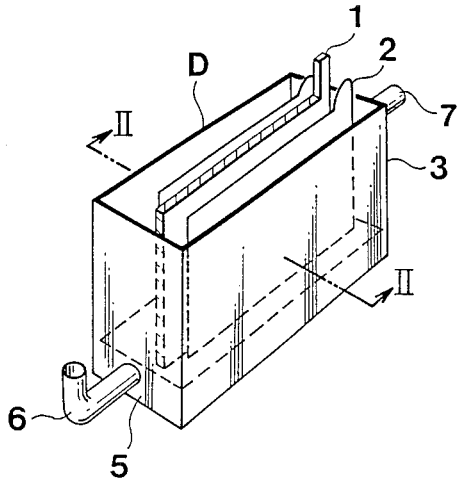
FIG. 1 is a perspective view of an electrolytic apparatus used in the present invention.

The objects of the present invention have been attained by a method for recovering silver from a silver-containing photoprocessing waste solution derived from the processing of silver halide photographic materials which comprises electrolyzing said waste solution under the condition that the applied voltage between a pair of electrodes is set at or higher than the potential at which the generation of sulfide ion takes place. In this method, the resultant precipitate of silver sulfide is deposited and accumulated within the electrolytic cell.

When viewed from the point of the electrode potential level at which silver sulfide is formed under an applied voltage between a pair of electrodes enough to form silver sulfide, it is considered that there are two cases. For one case, silver sulfide is formed by sulfide ions resulting from the reduction reaction of thiosulfate or sulfite salts by setting the cathode potential at or lower than the potential at which sulfide ion is generated.

Another case is that silver sulfite is formed by setting the anode potential at or higher than the potential at which the oxydation decomposition of thiosulfate or sulfite salts occurs. In the latter case, the potential may be preferably such a level that proton is generated by the electrolysis of water to further promote the formation of silver sulfide.

In either case of electrode potential, it is enough that silver sulfide is formed and precipitated in the cell. The higher voltage provides the conditions under which the cathode or anode is set easily at the above potential. Further it is possible that the electrode potential is set independently over the voltage, and that a standard electrode is used as a third electrode. In this case, the potential to generate sulfide ion is attained without elevating the voltage to a particularly high level. The above-mentioned lower limit of the potential at which sulfide is generated includes this case.

In order to carry out the electrolysis to form silver sulfide by either or both potential being set at preferable level, the following procedure can be employed.

In the claims and specification, "to set at or higher than the potential at which the generation of sulfide ion takes place" means the condition at which the precipitate of silver sulfide is formed. To be more concretely, it means the condition at which the precipitate of silver sulfide, $Ag_2S$, is formed at the bottom of cell without occurring the deposition of metal silver on the cathode. Whether the applied voltage is enough to satisfy such condition can be easily discriminated by observing the state in the cell after allowing the electricity to pass for 2 to 3 hours.

In the present invention, the applied voltage between pair of electrodes is generally 0.2 V or over, preferably 0.5 to 15 V. The most suitable voltage range varies depending on the silver content, the contents and types of salts of the silver-containing solution, the temperature of the silver-containing solution, the degree of stirring, the distance between the electrodes, and the areas of the electrodes. A change in the most suitable voltage range also takes place during the operation due to a change in the concentration of silver caused by the electrodeposition of silver. Therefore, the voltage to be applied is selected in accordance with the conditions. Although it is practical to continue the electrolysis under a constant applied voltage, it is also possible that while the resistance (conductivity), the pH, the silver content, etc. are monitored, the electrolysis can be carried out with the applied voltage being adjusted in accordance with the monitoring values. For efficient electrolysis, the current density and the potentials of both electrodes are essentially important.

In the present invention, the current density will be set to from 0.5 $A/dm^2$ to 30 $A/dm^2$. Herein, the term "current density" means an average current density from the start of the electrolysis to the time when 70 % of the required quantity of electricity has been passed.

In the present invention, either the cathode potential is set at or lower than the potential at which the generation of sulfide ion takes place or the anode potential is set at or higher than the potential at which sulfide is formed in the electrolytic cell.

The anode potential is necessary to set at higher level, in the case in which silver sulfide is formed by an anodic oxydation. In the present invention, it is preferable that the anode potential is at a potential where sulfites and thiosulfates can be oxidized to produce sulfates and protons. In particular, the electrolytic voltage of the present invention is adjusted to a level at which both the generation of sulfide ion by decomposition and/or reduction of thiosulfate and/or sulfite ions and the generation of proton accompanied by electrolytic oxidation of sulfite and/or thiosulfate takes place. In this case the reactions is presumed as follows:

$$2SO_3^{2-} \longrightarrow S_2O_6^{2-} + 2c \xrightarrow{+2H_2O} 4H^+ + 2c + 2SO_4^{2-}$$

$$S_2O_3^{2-} \xrightarrow{+3H_2O} 6H^+ + 4e + 2SO_3^{2-}$$

$$2S_2O_3^{2-} \longrightarrow 2c + S_4O_6^{2-} \xrightarrow{6H_2O} 8H^+ + 6e + 4HSO_3^-$$

It is considered that the produced protons facilitate the production of sulfates in the following reactions.

$$S_2O_3^{2-} + H_2O \xrightarrow{H^+} SO_4^{2-} + H_2S$$

-continued $$H_2S + 2Ag(S_2O_3)_n^{1-2n} \longrightarrow Ag_2S + H_2S_2O_3 + (n-1)S_2O_3^{-2}$$

The concentration of $S_2O_3^{2-}$ in the waste solution of fixing or bleach-fixing bath is preferably 0.1 mol/l or more and that of $SO_3^{2-}$ is preferably 0.01 mol/l or more. However, in the present invention, the diluted solution of photoprocessing waste solutions (such as fixing, bleach-fixing, water-washing, and image-stabilizing solution) may also be treated. In such a solution, the amount of sulfur compounds may be $1.0\times10^{-5}$ mol/l or more, preferably $1.0\times10^{-4}$ mol/l or more.

In the prior method, the anode potential was set at −0.1 to 0.5 V, particularly at about 0 to 0.2 V versus saturated calomel electrode (hereinafter referred to as SCE) to prevent thiosulfates and sulfites from being oxidized. In the present invention, in order to oxidize them positively, the anode potential is at 0 V or over, preferably at 0 V to 10 V, more preferably at 0.3 V to 6V.

If the cathode potential is low, sulfites and thiosulfates are reduced to decompose and sulfide ion may also generate which is favorable for the present purpose. Consequently the cathode potential is set at −0.2 to −0.8 V, preferably −0.25 V or lower, more preferably −0.3 V or lower versus SCE, wherein "lower" means "more reductive".

As is apparent from the above description, the present invention differs from the prior arts in that the decomposition of thiosulfate and sulfite salts of the waste solution is carried out positively and directly.

If COD is to be lowered, or the silver recovery is to be continued at a low silver concentration, a high potential is applied. Therefore, the consumption of the anode due to corrosion will easily proceed. Thus, a lead peroxide anode of the present invention, which is described later, is suitable to be used under such conditions. That is, it becomes possible that there will be no corrosion of the electrode under a low silver concentration and a severe voltage condition, that the current density can be set high, and that silver can be recovered even until the concentration of silver becomes fairly low. In the present invention, the anode potential is set at a level where thiosulfate ion and organic ingredients that predominately contribute to the COD of the silver-containing waste solution are oxidized.

Further, in the present invention, it is preferable that the silver-containing solution (for example, bleach-fixing solution and fixing solution after bleaching) contains iron salts (for example, iron complex salt of aminopolycarboxylic acid), and the amount of the iron salts is usually 10 mg/l or over, preferably 0.5 g/l or over, more preferably 1 g/l or over, in terms of metal iron.

Now an electrolytic apparatus used in the present invention will be described.

(a) Electrodes

With respect to the general-purpose electrode material used for the electrolytic recovery of silver, an anode is made of carbon and a cathode is made of stainless steel, and these can be used in the present invention. Although known electrodes made of gold, platinum, or iridium, which are considered the most resistant to corrosion, can be used, an electrode made of lead peroxide is more preferable, as it exhibits excellent resistance to corrosion, greater than electrodes of the above noble metals, and it is needless to say that such an electrode is economical. Therefore it is particularly advantageous to employ this electrode, because, for example, the voltage applied to the anode in the recovery of silver can be made high, the number of the electrodes connected in series can be increased, and the electrolysis can be carried out while COD can be reduced.

It is preferable to use, as a lead peroxide electrode, one formed by cladding the opposite surfaces of a titanium steel plate with lead peroxide preferably, but of course the use is not limited to this, and a carbon plate, a carbon rod, a copper plate, a stainless steel plate, lead, and other suitable conductors may be used as the core material. Although the surface of the lead peroxide electrode may be smooth, it is more desirable that the surface of the lead peroxide electrode be suitably roughened. The lead peroxide may have any thickness in the range of 10 μm to several millimeters.

Although lead peroxide electrodes have long been used in storage batteries (secondary batteries), in the case of the present invention, that is, for electrolysis, it is preferable to use one that has physical strength by having a core material such as titanium and iron, and an example of such a lead peroxide electrode is one provided by Japan Carlit Co., Ltd.

(b) Electrolytic Cell

The electrolytic cell is suitably made of an insulating material such as a glass, a hard rubber, wood, or a synthetic resin, and in particular it is preferably made of a synthetic resin such as polyvinyl chloride, polymethyl methacrylate, polyethylene, polypropylene, polystyrene, and phenol-formaldehyde resin. On the other hand, it is suitable that the cathode is made of a conductor or semiconductor that can be used for a long period of time or can be used repeatedly, and particularly that the cathode is preferably made of stainless steel. With a lead peroxide electrode, an electrode potential, a current density, and a flow velocity suitable for suppressing the decomposition of sulfite ions and thiosulfate ions can be advantageously obtained.

Although a diaphragm is not necessarily required, if used it is desirably made of a material that allows electrons and liquids to pass through it but not large ions and molecules. As examples of such a material can be mentioned a semipermeable membrane (e.g., a cellulose acetate membrane whose surfaces have been hydrolyzed, cellophane, a copper ferrocyanide film, a bladder membrane, an intestinal wall membrane, and an agar membrane), an asbestos plate, an unglazed pottery plate, a glass plate, sintered glass, glass-wool, and a microporous synthetic polymer film (e.g., a polyvinyl chloride film, a polystyrene film, a polysulfone film, a polyester film, and a polypropylene film).

The term "electrode potential" in the specification and claims of the present invention is defined, when a reference potential is not mentioned, as an inner electric potential possessed by the electrode phase for the electrolyte solution phase in contact with the electrode, and although the absolute electrode potential cannot be measured, the relative value of the electrode potential can be found by forming a cell by combining the particular electrode with a specific reference electrode and by measuring the voltage between the terminals. The electrode potential indicated herein is the value measured by using a saturated potassium chloride/agar bridge. In this case, the reason potassium chloride is used as the bridge is to keep the contact potential difference as small as possible. However, since the solution to be measured is a solution containing silver ions, it is not suitable to use it for a long period of time or to use it repeatedly, and it is desirable to use it for a short period of time.

Stirring in the anode chamber (and the cathode chamber) can be carried out advantageously in the method of the present invention. The stirring operation includes, for example, the blowing of an inert gas, mechanical stirring, or electrical stirring.

The electrolytic cell has preferably at the bottom part thereof a storing chamber or space where precipitates, including silver sulfide, will settle and will be stored. Further it is preferable that the storing space and the electrode chamber are separated by a coarse screen or a perforated plate.

In the present invention, a silver-containing solution is intermittently or continuously introduced into the electrolytic bath, and simultaneously the solution present in the electrolytic bath is taken out in approximately the same amount as the amount of the introduced silver-containing solution, but it is preferable that electrolysis is carried out without replacing more than half of the solution existing in the cell.

A multi-staged electrolytic system is preferably used wherein a plurality of electrolytic cells are connected. In the system, in the former electrolytic cells, silver is recovered to a certain extent, and in some cases COD is also reduced, and then part or all of its overflow is fed to the latter electrolytic cells, where the removal of silver and the decrease of COD are further carried out to a higher degree.

Figure 2:
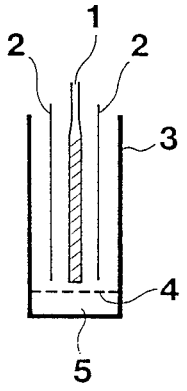
FIG. 2 is a section view along line II—II of FIG. 1.

The electrolytic apparatus of the present invention is described with reference to the drawings showing one embodiment thereof. FIG. 1 is a perspective view of the electrolytic apparatus D of the present invention, and FIG. 2 is a section view along line A—A of FIG. 1, wherein reference numeral 1 indicates a lead peroxide anode, reference numeral 2 indicates a stainless steel cathode, reference numeral 3 indicates an electrolytic bath, reference numeral 4 indicates a porous plate, and reference numeral 5 indicates a precipitate-storing chamber. Reference numeral 6 indicates a silver-containing solution inlet, and reference numeral 7 indicates a silver-containing solution outlet.

In a particularly advantageous embodiment of the present invention, during operation of the automatic processor, the overflows from each of the processing tanks or some of the processing tanks are introduced into the electrolytic cell, part of the solution resulting from its circulation in an amount corresponding to the introduced overflows is discharged from the electrolytic cell, and the removal of silver and decrease of COD are simultaneously carried out in the electrolytic cell by electrolytic reactions and non-electrolytic decomposition reactions. Even if the operator only operates the automatic processor, the waste solution can also be automatically processed, so that the electrolytic apparatus can serve as a simple and convenient means of processing the waste liquor. At night and during holidays, when the automatic processor is stopped, electricity can be passed continuously to reduce COD further, or the electrolytic apparatus can be stopped while enough voltage is applied to prevent the silver from dissolving from the electrode.

Figure 3:
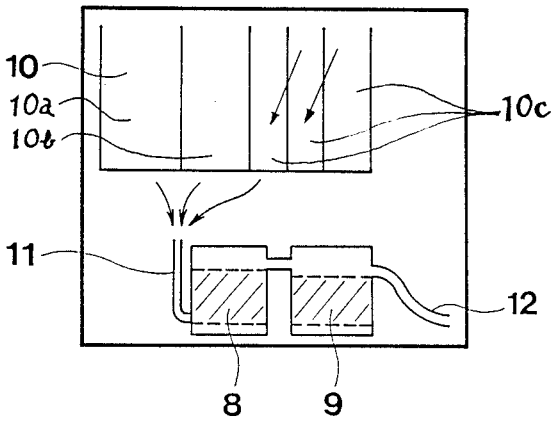
FIG. 3 is a schematic view of another example of the present invention wherein the electrolyticytic cell is built in an automatic processor.

FIG. 3 is a schematic view of an embodiment of the present invention, wherein the electrolytically treated solution of a first electrolytic cell 8 is overflowed into a second electrolytic cell 9, and the overflow from a processor (automatic processor) 10 is supplied into electrolytic cell 8. Reference numeral 11 indicates an inlet of solution to be electrolytically treated, and reference numeral 12 indicates an electrolytically treated solution outlet. Reference numeral **10*a* indicates a color-developing bath, reference numeral 10*b* indicates bleach-fixing-bath, and reference numeral 10*c*** indicates a water-washing bath (3 stage counter current mode).

The electrolytic apparatus used in the present invention can be combined with various stirring mechanisms described in West German Patent Application (OLS) No. 2,848,577, JP-A ("JP-A" means unexamined published Japanese patent application) No. 31820/1972, U.S. Pat. Nos. 2,791,556, 2,832,734, 2,615,839, 2,153,188, 1,954,316, and 1,959,531, and British Patent Nos. 683,335 and 1,123,168. Further, various contrivances for the electrode described in JP-A Nos. 23732/1976 and 270753/1986, *Research Disclosure* No. 18926 (1980, No. 189), and EP No. 37325 can also be applied. Further, various voltage-adjusting functions disclosed in JP-A No. 19535/1976, *Research Disclosure* No. 20933, JP-A Nos. 18212/1976 and 126995/1983, and U.S. Pat. No. 1,900,893 can also be combined. The arrangement of the cathodes and the anodes can take any of the known forms. For example, in a preferable mode, lead peroxide rectangular electrodes are arranged into the shape of a polygonal column around the inner circumferential wall of a cylindrical electrolytic cell, and a rotating cylindrical stainless steel cathode is arranged inside the polygonal column and rotated at a high speed.

The positional relationship of the rotating cylindrical cathode and the anodes may be reversed so that the anodes are located inside.

In another mode, the cathodes and the anodes may be in the shape of a rectangular plate, they may be arranged alternatively in series and in parallel, they may be arranged in series or parallel, and they may be mounted in a rectangular electrolytic cell. In that case it is preferable that stirring is effected transversely or vertically, so that currents of the solution in the electrolytic cell may be parallel with the electrode plate surfaces. In order to effect easily the settling of precipitates, and to keep the natural circulation of the solution good, it is particularly advantageous that the electrodes are vertically arranged.

Development processing solutions that will be processed according to the present invention, the method according to the present invention, and photographic materials that will be processed according to the present invention will now be described.

Processing solutions that will be processed according to the present invention are generally photographic processing solutions containing silver. For example, silver-containing solutions can be processed, such as fixing solutions, silver-containing washing waste waters, silver-containing rinsing solutions, and stabilizing bath solutions for black-and-white silver salts photographic materials, and fixing solutions, bleach-fixing solutions, silver-containing washing waste waters, silver-containing rinsing solutions, and stabilizing bath solutions for color photographic materials.

The components in these processing solutions are apparent by themselves, there are no limitations thereon, and they will be described below.

Fixing solutions that can be processed include any fixing solution ranging from a plain hypo solution to an acid fixer with a hardener. Also, a combined developing and fixing bath can be processed. A plain hypo solution is a neutral to weak alkaline fixing solution that is a solution containing only a thiosulfate, optionally a sulfite, as a preservative, and it is used when acid solution is not preferably used in view of the properties of the dye image or for other reasons or when it is necessary to obviate hardening of the image film. A plain hypo solution is, for example, used for processing wash-off-relief-type photographic materials, certain color reversal photographic materials, and materials for scientific photography. An acid fixer with a hardener contains, in addition to a fixer and a preservative, a hardener, a buffer, and an acid agent for adjusting the pH suitably to secure a hardening effect. The acid agent and the buffer include acetic acid, citric acid, carbonic acid, boric acid, phosphoric acid, malic acid, maleic acide, oxalic acid, formic acid, tartaric acid, and succinic acid, their alkali metal salts, and ammonium salts. The hardener includes potassium alum, chromium alum, ammonium alum, and other water-soluble aluminum salts and chromium salts.

As the fixing agent, use can be made of thiosulfates, thiocyanates, thioether compounds, and thioureas, and particularly ammonium thiosulfate, which has a rapid fixing property and is used in many cases. As the preservative, use is made, for example, of a sulfite, a bisulfite, and a metabisulfite. The fixing solution can additionally contain, for example, a bactericide, a germ-proofing agent, and a toning dye according to the purpose as described below. Other additives are described in *Kagaku Shashin Binran.* Vol. II (published by Maruzen Co., Ltd.), and in L.F.A. Mason, *Photographic Processing Chemistry* (1968, Focal Press).

As a bleaching agent in the bleaching solution or the bleach-fixing solution, use can be made, for example, of compounds of polyvalent metals such as iron (III), cobalt (III), chromium (IV), and copper (II), peroxides, quinones, and nitro compounds. As a typical bleaching agent, use can be made, for example, of ferricyanides; bichromates; organic complex salts of iron (III) or cobalt (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropaneacetic acid, and glycol ether diaminetetraacetic acid, or citric acid, tartaric acid, and malic acid with iron(III) or cobalt(III); persulfates; bromates; permanganates; and nitrobenzenes. The pH of the bleaching solution or the bleach-fix solution is generally 5.5 to 8, but it may lower.

The bleaching solution, the bleach-fixing solution, and the bath before them contain a bleach accelerator if necessary. Specific examples of useful bleach accelerator are compounds having a mercapto group or a disulfide linkage, described, for example, in U.S. Pat. No. 3,893,858, West German Patent No. 1,290,812, JP-A No. 95630/1978, and *Research Disclosure* No. 17129 (July 1978); thiazolidine derivatives described in JP-A No. 140129/1975, thiourea derivatives described in U.S. Pat. No. 3,706,561, iodized product salts described in JP-A No. 16235/1983, polyoxyethylene compounds described in West German Patent No. 2,748,430, polyamine compounds described in JP-B ("JP-B" means examined Japanese patent publication) No. 8836/1970, and bromide ions. Among others, compounds having a mercapto group or a disulfide group are preferable in view of the great acceleration effect, and in particular, compounds described in U.S. Pat. No. 3,893,858, West German Patent No. 1,290,812, and JP-A No. 95630/1978 are preferable. Further, compounds described in U.S. Pat. No. 4,552,834 are preferable. These bleach acceleration agents may be added to photographic materials.

As the fixing agent can be mentioned thiosulfates, thiocyanates, thioether compounds, thioureas, and great amounts of iodide salts, although generally thiocyanates are used, and ammonium thiosulfate can be most widely used. As the preservative for the bleach-fixing solution, it is preferable to use sulfites, bisulfites, or carbonylbisulfite adducts.

After silver halide color photographic materials are desilvered, generally they are passed through a washing step and/or a stabilizing step.

In the case of washing water, it may contain isothiazolone and cyabendazole compounds described in JP-A No. 8542/1982, chlorine-type bactericides, such as sodium chlorinated isocyanurate, or bactericides described in Hiroshi Horiguchi *Bokin Bobai-zai no Kagaku,* in *Biseibutsu no Mekkin, Sakkin, Bobai Gijutsu,* edited by Eiseigizutsukai, and in *Bokin Bobai-zai Jiten,* edited by Nihon Bokin Bobai-gakkai.

The pH of the washing water is 4 to 9, preferably 5 to 8.

The stabilizing bath containing formaldehyde and a surface-active agent that is used as a final bath for color photographic material for photographing can also be processed. This stabilizing bath also may contain chelating agents and bactericides.

The present invention can be applied to any of the processing solutions that contain silver that is required to be recovered, such as the above-mentioned bleach-fixing solution, fixing solution, image stabilizing bath, and washing bath, as well as a developing solution in some cases.

A process to which the recovery of silver according to the present invention can be applied is any process that involves a bleaching step or a color-developing step. The color-developing solution is preferably an aqueous alkaline solution whose major component is an aromatic primary amine color-developing agent. As the color-developing agent, aminophenol compounds are useful, and p-phenylenediamine compounds are preferably used. Typical examples thereof include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, and 3-methyl-4-amino-N-ethyl-N-$\beta$-methoxyethylaniline, and their sulfates, hydrochlorides, and p-toluenesulfonates. Two or more of these compounds can be combined, depending on the purpose.

Generally the color-developing solution contains, for example, pH buffers, such as carbonates, borates, or phosphates of alkali metals, and antifoggants or development retarders, such as benzimidazoles, benzothiazoles, or mercapto compounds. If required it may further contain various preservatives, such as hydroxylamine, diethylhydroxylamine, sulfites, hydrazines, phenylsemicarbazides, triethanolamine, cartecholsulfonic acids, and triethylenediamine(1,4-diazabicyclo[2,2,2]octane); organic solvents, such as ethylene glycol and diethylene glycol; development accelerators, such as benzyl alcohol, polyethylene glycol, quaternary ammonium salts, and amines; dye-forming couplers; competing couplers; fogging agents, such as sodium boron hydride; auxiliary-developing agents, such as 1-phenyl-3-pyrazolidone; viscosity producers; various chelating agents, such as aminopolycarboxylic acids, aminopolyphosphonic acid, alkylphosphonic acids, and phosphonocarboxylic acids, typical examples thereof being ethylenediaminetetraacetic acid, nitrilotriacetic acid, diethylenetriaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If a reversal process is carried out, generally black-and-white development is conducted, followed by color development. In the bleaching and developing solution thereof, use can be made of known black-and-white developing agents, such as aminophenols, for example N-methyl-p-aminophenol, or 3-pyrazolidones, for example 1-phenyl-3-pyrazolidone, and dihyroxybenzenes, for example hydroquinone, which may be used alone or in combination.

Generally, the pH of these color-developing solutions and black-and-white developing solutions is 9 to 12. Although the replenishing amount of these developing solutions varies depending on the color photographic material to be processed, the replenishing amount is generally 31 or less per square meter of the photographic material, and it can be kept to 500 ml or less per square meter of the photographic material if the concentration of iodide ions in the replenisher is lowered. If the replenishing amount is lowered, it is preferable to prevent, by making small the contact area of the processing bath with air, the solution from evaporating and being oxidized. The replenishing amount can be reduced by using means of suppressing the volume of the bromide ions in the developing solution.

The silver halide color photographic material may contain a color-developing agent for the purpose of simplifying and quickening the process. To incorporate a color-developing agent, it is preferable to use various precursors of color-developing agents. Indoaniline-type compounds described, for example, in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, metal salt complexes described in U.S. Pat. No. 3,719,492, and urethane compounds described in JP-A No. 135628/1978 can be exemplified.

For the purpose of facilitating the color development, if necessary, the silver halide color photographic material may contain various 1-phenyl-3-pyrazolidones. Typical compounds are described, for example, in JP-A Nos. 64339/1981, 144547/1982, and 115438/1983.

The bleaching solution was described when the bleach-fixing solution was described.

The various processing solutions are used at 10 to 50° C. Generally the standard processing temperature is 33 to 38° C., but a higher processing temperature can be used to facilitate the processing, thereby shortening the processing time, whereas if a lower processing temperature is used, improvement of the image quality and stability of the processing solution can be achieved. Further, to save the silver in the photographic materials, a process wherein cobalt intensification or hydrogen peroxide intensification, as described in West German Patent No. 2,226,770 or U.S. Pat. No. 3,674,499, can be carried out.

A silver-containing solution to which the present invention will be applied is assumed to be one that will be reused after the removal of silver by electrolysis or one that will be discarded without reusing it after the removal of silver by electrolysis. A small amount of solution discharged from the reusing system is included in the solution of the discarding type in the present invention.

In the case of a non-reusing type, since it is not required at all to consider a change in the composition due to side reactions, the electrolysis time is prolonged or the applied voltage is increased so as to remove silver as much as possible. Ultimately the electrolysis is carried out to a level of 200 mg/l or less. Since the anode of the present invention is high in durability and can withstand severe conditions, the anode is particularly advantageous in such a case.

The present invention can be applied to silver-containing solutions that use commercially available fixing agents, bleaching agents, and stabilizing baths.

The silver-containing solutions to which the present invention will be applied are ones that have processed any photographic material. There is no particular limitation on the photographic material to be processed, and examples of the photographic material are color negative films, color papers, color reversal films, color reversal papers, films and papers for photomechanical processes and photocomposition, COM films, graph films, microfilms, and medical X-ray films.

Effects of the present invention will be described below.

(a) Improvement of Recovering Ability

A major feature of the present invention is to recover silver as silver sulfide. Since the prior electrolytic method of recovering silver as metallic silver is needed to prevent sulfidiation, a limited current density and a low electrolytic voltage are used, and therefore the electrolytic speed is low, which is nonproductive. In this prior method the average current density was at most 2 A/dm$^2$, and generally 1 A/dm$^2$ or below. In contrast, in the present invention, since positive sulfidiation is suitable for the purpose, the average current density can be set over at 2 A/dm$^2$ and up to 30 A/dm$^2$, which is high. As a result the silver recovery ability per unit area of the electrode or per unit volume of the apparatus can be remarkably increased.

(b) Improvement of Desilvering Ability

The ability of desilvering from a silver-containing solution of the prior silver recovering method was limited. That is, when the electrolysis of silver has proceeded, and the concentration of silver has lowered, since lowering of the current efficiency and an increase in the applied voltage cause sulfidiation to take place and the electrodes to be poisoned and worn, when the processing solution is to be reused (reusing mode), silver is removed until the concentration of silver reaches 0.5 to 1.0 g/l, which is almost a practical limit, and when the processing solution is discarded without reusing it after the recovery of silver (tailing mode), silver is removed until the concentration of silver reaches 0.05 g/l, which is almost a practical limit. If further removal of silver were done, the concentration would be down to 0.01 g/l. That is, when electrolysis is carried out with the electric current low in the prior method, if the electrolysis is continued until the concentration of silver becomes quite low, the electrodes are poisoned. Further, in low voltage electrolysis, due to the lowering of the electrolytic electric current, the electrolysis becomes inefficient. As a result, silver cannot be removed over a limit and that is a practical upper limit. Additionally, the reduction of recovered silver sulfide to silver can be easily carried out in a usual manner.

In contrast to that, in the method of the present invention, since sulfidiation is positively carried out, and silver sulfide is low in solubility, silver can be removed until the concentration of silver reaches 0.001 g/l or below. Therefore, silver can be recovered efficiently from a photographic processing waste solution.

(c) Simplification of the Structure of the Electrolytic Apparatus

As stated above, a method of electrolytically recovering silver as silver sulfide is disclosed in RD No. 13702. However, in the method a photographic processing solution is not electrolyzed in an electrolytic cell, and the electrolytic cell is used only to reduce a thiosulfate solution. Therefore, (1) in addition to the electrolytic cell, it is necessary to have a reaction tank where silver sulfide is produced and a solution transferring system, (2), a thiosulfate electrolyte solution must be prepared, and (3) the current density according to the description in RD No. 13702, differs naturally from the optimum current density of the present invention.

In contrast, in the present method such a complicated reaction tank and solution transferring system are not required, silver sulfide is produced in an electrolytic cell, the preparation of a thiosulfate electrolyte solution is not required, and the current density can be set high. As a result, according to the present invention, the electrolysis apparatus can be considerably simplified.

(d) Improvement of Sulfiding Efficiency

As described in (a), the present method is substantially high in recovery efficiency. It has also been found that the presence of iron salts further facilitates the production of silver sulfide. The presence of iron salts increases considerably the amount of the production of silver sulfide per a certain amount of passed electric current. Thus, the production efficiency further increases (making the apparatus small-sized, with a high capacity). Since iron salts are contained in bleaching solutions and bleach-fix solutions, the application of the present method to silver-containing solutions of color photographic materials is particularly advantageous. The concentration of iron salts present in the solution may be small, and in the case of a fixing solution after a bleaching solution, the concentration of iron salts resulted from the carry-in from the preceding bath is enough to bring about a great effect. In the case of a waste solution mixture of a silver-containing solution with a silver-free solution, such as a development waste solution, the production of silver sulfide can be carried out efficiently due to the presence of iron salts.

(e) Improvement of the Life of the Anode

In the present invention, it is particularly advantageous to use a lead peroxide electrode as the anode. If the sulfiding is caused positively, the applied voltage becomes high. As a result corrosion of the anode occurs easily, but when lead peroxide is used, the stability and the corrosion resistance can be considerably improved.

In addition, the electrode can be used for a long period of time without replacing it, and it is inexpensive. In particular, a lead peroxide electrode is most suitable as means of recovering silver for a small-scale photofinishing laboratory that does not need maintenance.

(f) Improvement in the Current Efficiency by Nonelectrolytic Sulfiding

It is considered that, in the present method, a nonelectrolytic chain reaction that has been induced by the electrolysis and that produces silver sulfide is taking place in the solution. Therefore, the current efficiency is remarkably high. At an anode potential above the oxidation potential of thiosulfates, the current efficiency of the production of silver sulfide increases, and the present method can be carried out more economically with electricity saved (energy saved).

(g) Good Separability of Precipitate

The situation that recovery of silver as silver sulfide is practically carried out only by a large scale chemical process is attributed to the fact that since the precipitate of silver sulfide is good in dispersibility and hardly settles, the separation of the precipitate of silver sulfide has to be done by a filter press, and therefore the scale of the apparatus becomes large. However when electrolysis is carried out at an anode potential over the electrolytic potential of sulfites and thiosulfates, the produced precipitate is a coalesced massive precipitate, and it can settle spontaneously.

Thus, a filter press or even other smaller scale pressing/filtering equipment is not required, and a simple operation for recovering silver in a small-scale photofinishing laboratory becomes possible. This is not expected from the prior sulfide-type electrolytic system.

(h) Lowering of COD in Waste Solution

The prior method of electrolytically recovering silver obviates anodic reduction of thiosulfate ions and cathodic oxidation of thiosulfate ions, and is carried out with the applied voltage limited, whereas, as repeatedly stated above, in the present invention, since it is necessary to bring about positive sulfiding, it is not necessary to suppress the applied voltage to a lower level. When thiosulfates and sulfites in a photographic processing solution are anodically oxidized with the applied voltage kept high, COD due to them can be reduced. A major merit of the present invention is that COD can be reduced remarkably by oxidizing thiosulfates and sulfites that are highly attributed to COD in a photographic processing waste liquor.

When the voltage is increased, various components that are attributed to COD and that are present in photographic processing solutions, such as developing agents, benzyl alcohol, and aminopolycarboxylic acids, are oxidized, and COD can be further lowered. Consequently, silver is removed and at the same time COD is also lowered, so that legal regulations concerning waste water can be easily met.

It is needless to say that it is quite advantageous that an operation to remove silver can lower COD in a small-scale photofinishing lab, which cannot be equipped with the existing means of lowering COD and BOD.

(i) Continuous Processing

A further advantage of the present invention is that continuous processing can further expand the advantage of the present invention. As stated in (f), when the applied voltage is high, the pH is lowered, nonelectrolytic decomposition of thiosulfates also occurs, effective production of silver sulfide takes place, and COD lowers. If a waste solution is flowed into an electrolytic cell little by little, since the pH in the electrolytic cell can be kept low, the above advantageous situation can be retained.

(j) Removal of Iron Compounds

According to the present process, iron compounds are also removed. As a result, in a region where a restriction is imposed on the discharge of iron salts, the present method exhibits a further advantage.

The invention will now be further described in detail with reference to Examples.

EXAMPLE 1

(1) In a photofinishing laboratory where a CN-16 process (produced by Fuji Photo Film Co., Ltd.) (development - bleaching - fixing - washing - stabilizing bath - drying), which is a general-purpose color negative process, and a CP-23 process (produced by Fuji Photo Film Co., Ltd.) (development - bleach-fixing - washing - drying), which is a general-purpose color paper process, are carried out, the following three electrolytic silver recovery apparatuses were used to recover silver in processing solutions as follows:

1. The electrolytic apparatus for the overflow of the fixing solution:

The concentration of silver was reduced from 7 g/l to 0.5 g/l.

2. The electrolytic apparatus for the overflow of the bleach-fixing solution:

The concentration of silver was reduced from 2.5 g/l to 0.5 g/l.

3. The electrolytic apparatus for the mixture of the electrolyzed waste solutions from 1 and 2.

The concentration of silver was reduced from 0.5 g/l to 0.05 g/l.

The electrolytic cells used above had the same structure as shown in FIG. 1, and in 1 and 2, electrolytic cells using carbon anodes were used, and in 3, electrolysis was carried out using lead peroxide anodes.

In 3, the applied voltage was 3 V, which was a severe condition, but silver was removed, and COD was lowered without wearing the electrodes.

(2) When, instead of the CN16-type processing and the CP23-type processing in (1) above, a combination of processes of other makers of photographic materials, for example, a combination of a C41 process and an EP-2 process by Eastman Kodak Co. was used, the same results were obtained.

(3) The electrolysis 1 of the fixing solution in (1) was carried out until the concentration of silver reached 1.0 g/l, and the solution was returned to the fixing tank to be reused, with 20 % of the solution being transferred to the step 3. Thus, the amount of fixing solution used was saved.

(4) In (1), a stayed water-washing system (so-called low flow wash system) was used in each of the first washing tanks of the color negative processor and the color paper processor, and therefore the electrolytic cell 3 was also used to recover silver of the stayed water washing waste solution. The applied voltage was set at 4 V, and the current density was about 5 A/dm$^2$.

(5) In the color negative process and the paper-type process mentioned under (1) and (2), the silver-containing solution was not treated in two steps, but was electrolyzed in one step using only the electrolytic cell in 3 until the concentration of silver reached 0.02 g/l. In this case the current density was initially 7 A/dm$^2$, and finally 2.5 A/dm$^2$, and the COD value could be reduced to 1/50.

(6) In (1), (2), and (4), the silver-containing waste solution of the color negative processor and the silver-containing waste solution of the color paper processor were individually processed in one step, until the concentration of silver was reduced to 0.02 g/l. The COD value of each of them was lowered to 1/30 to 1/100.

(7) The structure was such that in a mini-lab 23 using CN16Q and CP25Q, each of the electrolytic cells was integrated with each of the developing apparatuses, and during the processing, the silver-containing overflow flowed into the electrolytic cell all the time, and the overflow of the electrolytic cell was stored in a waste solution tank. The electrolytic cells used lead peroxide anodes, the applied voltage was 8 V, and the current density was 6 to 4 A/dm$^2$ all the time. Even during suspension of the developing operation at night, generally the electrolysis was continued automatically.

The operator of the mini-lab scarcely performed the routine operation of the electrolytic recovering apparatus. The concentration of silver in the overflow discharged from the electrolytic cell was 2 mg/l or below, and the COD was 400 mg/l or below.

EXAMPLE 2

Multilayer color negative films, Super HR-100, HR-100, HR-200, Super HR-400, HR-400, and HR-1600 (trade names, manufactured by Fuji Photo Film Co., Ltd.), VR-100, VR-400, and VR-1000 (trade names, manufactured by Eastman Kodak Co.), and SR-100, SR 400, SR-1600, and RG-100 (trade names, manufactured by Konishiroku Photo Industry Co., Ltd.) that were commercially available and with which photographs had been taken, were randomly mixed and successively processed through a color negative film processor of a Fuji Mini-Lab 23 S (manufactured by Fuji Photo Film Co., Ltd.)

The processing step, the processing temperature, the processing time, and the replenishing amount are given in Table 1.

TABLE 1

| Step | Temperature | Time | Replenishing amount |
|---|---|---|---|
| Color development | 38° C. | 3 min. 15 sec. | 40 ml/m |
| Bleach | 38° C. | 3 min. | 20 ml/m |
| Fixing | 38° C. | 4 min. | 30 ml/m |
| Stabilization (1) | 35° C. | 45 sec. | — |
| Stabilization (2) | 35° C. | 45 sec. | — |
| Stabilization (3) | 35° C. | 30 sec. | 30 ml/m |
| Drying | 50° C. | 1 min. | — |

The processing solutions used in the steps were as follows:

| | Tank solution | Replenisher |
|---|---|---|
| Color-developing solution | | |
| Diethylenetriaminepentaacetic acid | 3.0 g | 3.0 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N-ethyl-N-β-hydroxyethylamino)-2-methylaniline sulfate | 4.5 g | 5.0 g |
| Water to make | 1.0 l | 1.0 l |
| pH | 10.0 | 10.0 |
| Bleaching solution | | |

-continued

| | Tank solution | Replenisher |
|---|---|---|
| Ethylenediaminetetraacetic acid ferric ammonium salt | 100.0 g | 110.0 g |
| Ethylenediaminetetraacetic acid disodium salt | 8.0 g | 10.0 g |
| Ammonium bromide | 150.0 g | 175.0 g |
| Ammonium nitrate | 8.0 g | 10.0 g |
| Aqueous ammonia (28%) | 7.0 ml | 4.0 ml |
| Water to make | 1.0 l | 1.0 l |
| pH | 6.0 | 5.7 |
| Fixing solution | | |
| Ethylenediaminetetraacetic acid disodium salt | 2.0 g | 4.4 g |
| Sodium sulfite | 16.0 g | 7.0 g |
| Aqueous ammonium thiosulfate solution (70%) | 200.0 ml | 240 ml |
| Sodium bisulfite | 4.0 g | 12.2 g |
| Aqueous ammonia | — | 10.0 m |
| Water to make | 1.0 l | 1.0 l |
| pH | 7.3 | 7.5 |
| Stabilizing solution | | |
| Formalin | 0.01 mol | 0.015 mol |
| Fuji Driwel | 5.0 ml | 5.0 ml |
| Disodium ethylenediaminetetraacetate | 250 mg | 250 mg |
| Water to make | 1.0 l | 1.0 l |

On the other hand, to obtain prints from the color negative films that had been developed, printing was carried out from the color negatives on a commercially available color paper) Fuji Color Paper 02 type, manufactured by Fuji Photo Film Co., Ltd.), and the color paper was processed by a paper processor of a Fuji mini-lab 23S. The processing step and the processing time are given in Table 2.

TABLE 2

| Step | Temperature | Time |
|---|---|---|
| Color development | 38° C. | 2 min. sec. |
| Bleach-fixing | 33° C. | 1 min. 00 sec. |
| Rinse 1 | 30° C. | 1 min. 00 sec. |
| Rinse 2 | 30° C. | 1 min. 00 sec. |
| Rinse 3 | 30° C. | 1 min. 00 sec. |
| Drying | 80° C. | 50 sec. |

The rinse bath was 3-stage countercurrent washing from rinse 3 to rinse 1.

The details of the processing solution used in the color-development step and the bleach-fix step were as follows.

| | Tank solution | Replenisher |
|---|---|---|
| Color-developing solution | | |
| Water | 800 ml | 800 ml |
| Diethylenetriaminepentaacetic acid | 3.0 g | 3.0 g |
| Benzyl alcohol | 15 ml | 19 ml |
| Diethylene glycol | 10 ml | 10 ml |
| Sodium sulfite | 2.0 g | 2.3 g |
| Potassium bromide | 0.3 g | — |
| Potassium carbonate | 30.0 g | 25.0 g |
| N-ethyl-N-(β-methanesulfonamidoethyl)-3-methyl-4-aminoaniline sulfate | 5.5 g | 7.5 g |
| Hydroxylamine sulfate | 4.0 g | 4.5 g |
| Brightening agent (stilbene type) | 1.0 g | 1.5 g |
| Water to make | 1.0 l | 1.0 l |
| pH adjusted with KOH to | 10.80 | 11.0 |

-continued

| | Tank solution | Replenisher |
|---|---|---|
| Bleach-fix solution | | |
| Water | 400 ml | 400 ml |
| Ammonium thiosulfate (70%) | 150 ml | 150 ml |
| Sodium sulfite | 18 g | 36 g |
| Ethylenediaminetetraacetic acid iron(III) ammonium | 55 g | 110 g |
| Ethylenediaminetetraacetic acid | 5 g | 10 g |
| Water to make | 1.0 l | 1.0 l |
| pH | 6.75 | 6.30 |
| Rinse solution | | |
| 1-Hydroxyethylidene-1,1-diphosphonic acid (60%) | 2.5 ml | 2.5 ml |
| Aqueous ammonia (28%) | 1.8 ml | 1.8 ml |
| Water to make | 1.0 l | 1.0 l |
| pH adjusted with KOH to | 7.0 | 7.0 |

The replenishing amounts of the color-development solution, the bleach-fix solution, and the rinse solution were 160 ml, 60 ml, and 200 ml per square meter of the printing paper, respectively.

The waste solutions from the tanks of the film processor and the paper processor were mixed and collected into a waste solution storing tank. The combined waste solutions were electrolyzed in an experimental electrolytic cell having a volume of 200 ml, as shown in FIG. 1, with a direct current of 8 V being applied and the current density being 6 A/dm$^2$. The results after 16 hours of electrolysis are shown below:

| | Before electrolysis | After electrolysis | Iron |
|---|---|---|---|
| COD | 38000 mg/l | 710 mg/l | 1050 mg/l |
| Silver | 1050 mg/l | 0.75 mg/l | 15 mg/l |

It can be understood that the efficiency of iron removing is quite high. It is said that in the prior method (silver was electrodeposited as metallic silver) the removal of silver to a level of 50 mg/l was very difficult.

COD is also surprisingly reduced.

It is shown that the concentration of iron salts is considerably lowered. According to the present invention, the precipitate of silver sulfide can be collected very effectively at the store chamber 5 in the lower part of the electrolytic cell 3, because the precipitate fall as course particle.

A change in the weight of the anode (lead peroxide) between before and after the electrolysis was not observed in terms of a unit of 1 mg, which meant the electrode exhibited a practical corrosion resistance.

It was found that when a palladium electrode and a carbon electrode were used under the same electrolytic conditions, there was a certain amount of changes in the weight. However, it was found that the ability of recovering silver in these electrodes was the same as that in the lead peroxide.

According to the present invention, all the steps such as electrolysis, sulfidication, and precipitation were carried out in the electrolytic cell. Thus, there was no need to provide an additional reaction tank and settling tank.

EXAMPLE 3

Two electrolytic cells of Example 1 were connected, and electrolysis was carried out in such a manner that, as shown in FIG. 2, the overflow from the first cell flowed into the second cell, and the overflow from the second cell was discharged outside the system. After 10 hours from the start of the electrolysis, 12 ml per hour of the combined waste solutions in Example 1 were added to the first cell, and the electrolysis was continued. The COD, and the concentrations of silver and iron salts of the overflow of the second cell were approximately the same as those after electrolysis of Example 1.

Thus, it can be understood that electrolytic cells can be connected in series and built in a processor to continue electrolysis at all times.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for recovering silver from a silver-containing photoprocessing waste solution derived from the processing of silver halide color photographic materials and including thiosulfate and iron complex salts, which comprises electrolyzing said waster solution under the condition that the applied voltage between a pair of electrodes is set at or higher than the potential at which the generation of sulfide ion takes place, said electrolysis being continued to an extent that a substantial amount of thiosulfate initially present is decomposed and the photoprocessing waste solution is not suitable for reuse as a photoprocessing solution.

2. The method as claimed in claim 1, wherein the precipitate of silver sulfide is formed in an electrolytic cell.

3. The method as claimed in claim 1, wherein either the cathode potential is set at or lower than the potential at which the generation of sulfide ion takes place or the anode potential is set at or higher than the potential at which sulfide is formed in the electrolytic cell.

4. The method as claimed in claim 1, wherein the silver-containing waste solution comprises at least one of waste solutions that has been used for the processing of a color photographic material and that contains iron complex salts.

5. The method as claimed in claim 1, wherein the waste solution contains 10 mg or more of iron salts per liter of the solution in terms of metal iron.

6. The method as claimed in claim 1, wherein the waste solution contains $1.0\times10^{-5}$ mol or more of sulfur compounds per liter of the solution.

7. The method as claimed in claim 1, wherein the silver-containing photoprocessing waste solution comprises the waste solutions from the fixing, bleach-fixing, water-washing, and/or image stabilizing bath of the processing of the photographic materials.

8. The method as claimed in claim 1, wherein a lead peroxide electrode is used as an anode.

9. The method as claimed in claim 1, wherein the electrolytic voltage is adjusted to a level at which both the generation of sulfide ion by decomposition and/or reduction of thiosulfate and/or sulfite ions and the generation of protons accompanied by electrolytic oxidation of sulfite and/or thiosulfate take place.

10. The method as claimed in claim 1, wherein the anode potential is at a level where thiosulfate ion and/or sulfite ion of the silver-containing waste solution can be oxidized.

11. The method as claimed in claim 1, wherein the anode potential is at a level where thiosulfate ion and organic ingredients that contribute to the COD of the silver-containing waste solution are oxidized.

12. The method as claimed in claim 1, wherein the applied voltage between the pair of electrodes is 0.2 V or over.

13. The method as claimed in claim 1, wherein the current density is 0.5 to 30 $A/dm^2$ at the surface of the electrode.

14. The method as claimed in claim 1, wherein the anode potential is set at 0 V or more versus a saturated calomel electrode.

15. The method as claimed in claim 1, wherein the cathode potential is set at −0.2 to −0.8 V versus a saturated calomel electrode.

16. The method as claimed in claim 1, wherein a stainless steel electrode is used as a cathode.

17. The method as claimed in claim 1, wherein the electrolytic cell has at the bottom part a space section where precipitates settle and accumulate.

18. The method as claimed in claim 1, wherein the electrolytic cell comprises an electrolytic chamber and a space located at the lower part of the cell to store precipitates, wherein the chamber and the space are separated by a coarse screen or a perforated plate.

19. The method as claimed in claim 1, wherein the method comprises carrying out the electrolysis without replacing more than half of the solution present in the bath while introducing the silver-containing waste solution into the electrolytic cell, and at the same time discharging the solution in the bath in an amount approximately corresponding to the amount of the introduced solution.

20. The method as claimed in claim 1, wherein the method comprises carrying out the electrolysis employing a multi-staged electrolytic system wherein a plurality of electrolytic cells are connected in such a way that, in earlier electrolytic cells, silver is recovered to a certain extent, and optionally COD is also reduced, and part or all of its overflow is fed to later electrolytic cells, where the removal of silver and the decrease of COD are further carried out to a higher degree.

* * * * *